US010679591B2

(12) United States Patent
Steinhauser

(10) Patent No.: US 10,679,591 B2
(45) Date of Patent: Jun. 9, 2020

(54) TRIGGER TRAY FOR PERCUSSION INSTRUMENT

(71) Applicant: GEWA music GmbH, Adorf (DE)

(72) Inventor: Ruben Steinhauser, Altusried (DE)

(73) Assignee: GEWA music GmbH, Adorf (DE)

( * ) Notice: Subject to any disclaimer, the term of this patent is extended or adjusted under 35 U.S.C. 154(b) by 0 days.

(21) Appl. No.: 15/847,557

(22) Filed: Dec. 19, 2017

(65) Prior Publication Data

US 2018/0174556 A1 Jun. 21, 2018

Related U.S. Application Data

(60) Provisional application No. 62/437,609, filed on Dec. 21, 2016.

(51) Int. Cl.

| | |
|---|---|
| ***G10D 13/01*** | (2020.01) |
| ***G10D 13/02*** | (2020.01) |
| ***G10H 1/32*** | (2006.01) |
| ***G10H 3/14*** | (2006.01) |
| ***G10D 13/10*** | (2020.01) |

(52) U.S. Cl.

CPC ..... *G10D 13/02* (2013.01); *G10D 13/26* (2020.02); *G10H 1/32* (2013.01); *G10H 3/146* (2013.01); *G10H 2230/275* (2013.01); *G10H 2230/301* (2013.01)

(58) Field of Classification Search

CPC ..... G10H 2230/305; G10H 3/06; G10H 2230/285; G10D 13/01; G10D 13/02

See application file for complete search history.

(56) References Cited

U.S. PATENT DOCUMENTS

| | | | | |
|---|---|---|---|---|
| 4,242,937 | A * | 1/1981 | Pozar | G10D 13/02 84/411 R |
| 6,881,885 | B2 | 4/2005 | Donels | |
| 7,385,135 | B2 | 6/2008 | Yoshino | |
| 7,491,877 | B1 * | 2/2009 | Cherny | G10D 13/02 84/411 R |
| 8,563,843 | B1 * | 10/2013 | Shemesh | G10H 7/00 84/723 |
| 9,424,827 | B2 * | 8/2016 | Gill | G10H 3/12 |
| 9,721,549 | B2 | 8/2017 | Sikra | |
| 2004/0118269 | A1 | 6/2004 | Yoshino | |
| 2005/0150366 | A1 | 7/2005 | Sasami | |
| 2006/0156910 | A1 | 7/2006 | Yoshino | |

(Continued)

OTHER PUBLICATIONS

International Search Report for Application No. PCT/US2018/13917; dayed May 15, 2018.

(Continued)

*Primary Examiner* — Marlon T Fletcher

(74) *Attorney, Agent, or Firm* — Posz Law Group, PLC

(57) ABSTRACT

Trigger trays for use with a musical instrument trigger are disclosed. The trigger tray can fit within a drum assembly beneath a playing surface such as a drum head or drum pad. The trigger can be connected to the drum head or drum pad, or can be actuated through vibration of the trigger tray. The trigger tray can include a cutout on its underside or bottom side. The trigger tray can include a substantially circular head mount portion and a trigger mount portion therein, with a plurality of arms connecting the head mount portion to the trigger mount portion.

22 Claims, 6 Drawing Sheets

(56) References Cited

U.S. PATENT DOCUMENTS

| | | | | |
|---|---|---|---|---|
| 2007/0234886 | A1* | 10/2007 | Matsuyuki | G10D 13/024 84/723 |
| 2013/0047826 | A1 | 2/2013 | Wissmuller | |
| 2013/0180388 | A1 | 7/2013 | Mori | |
| 2015/0027301 | A1* | 1/2015 | Shih | G10H 3/12 84/730 |
| 2015/0294658 | A1* | 10/2015 | Gill | G10H 3/12 84/723 |
| 2016/0196811 | A1 | 7/2016 | Shen | |
| 2016/0210943 | A1 | 7/2016 | Sikra | |
| 2018/0174556 | A1* | 6/2018 | Steinhauser | G10D 13/024 |

OTHER PUBLICATIONS

International Search Report for Application No. PCT/US2017/067605; dated 26, 2018.

* cited by examiner

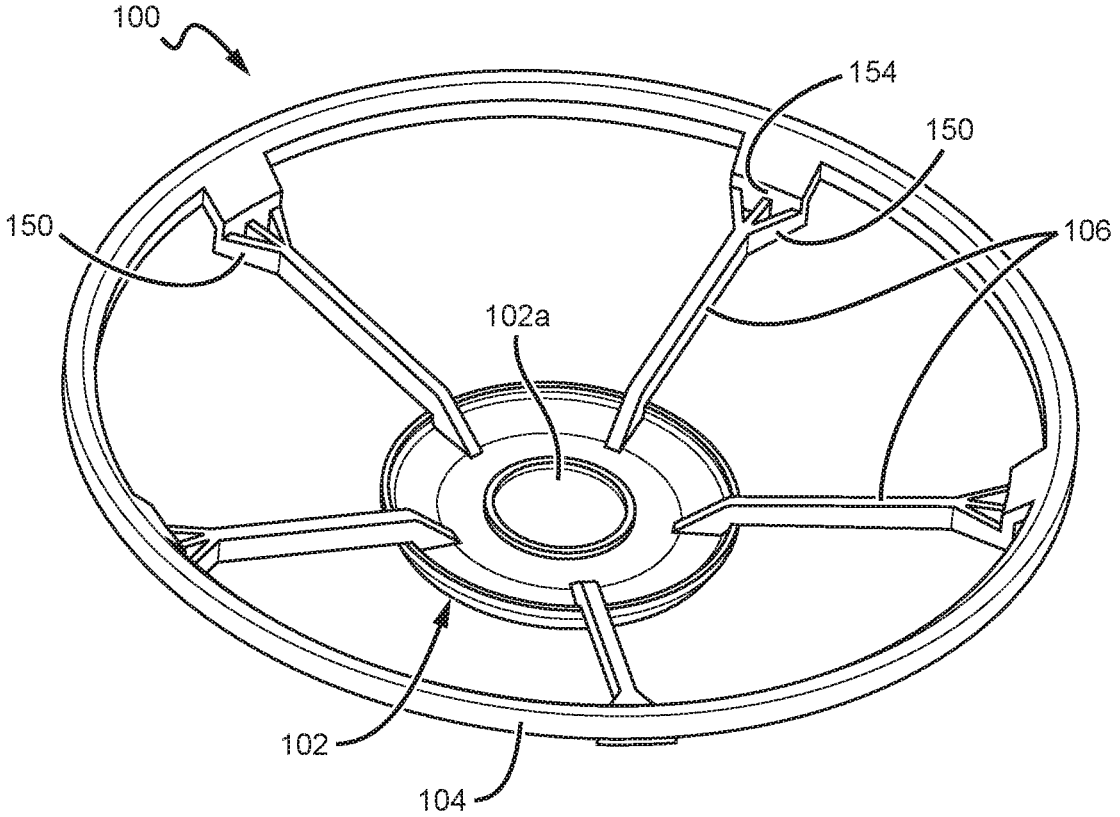
FIG. 1A
FIG. 1B
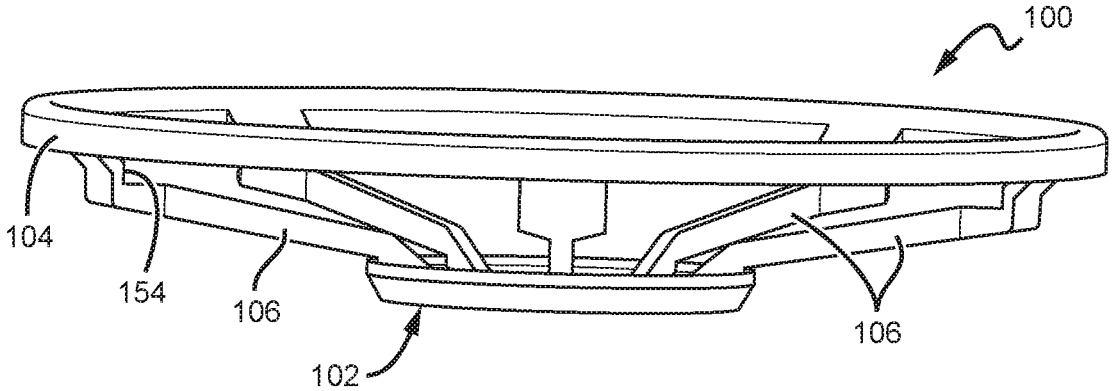

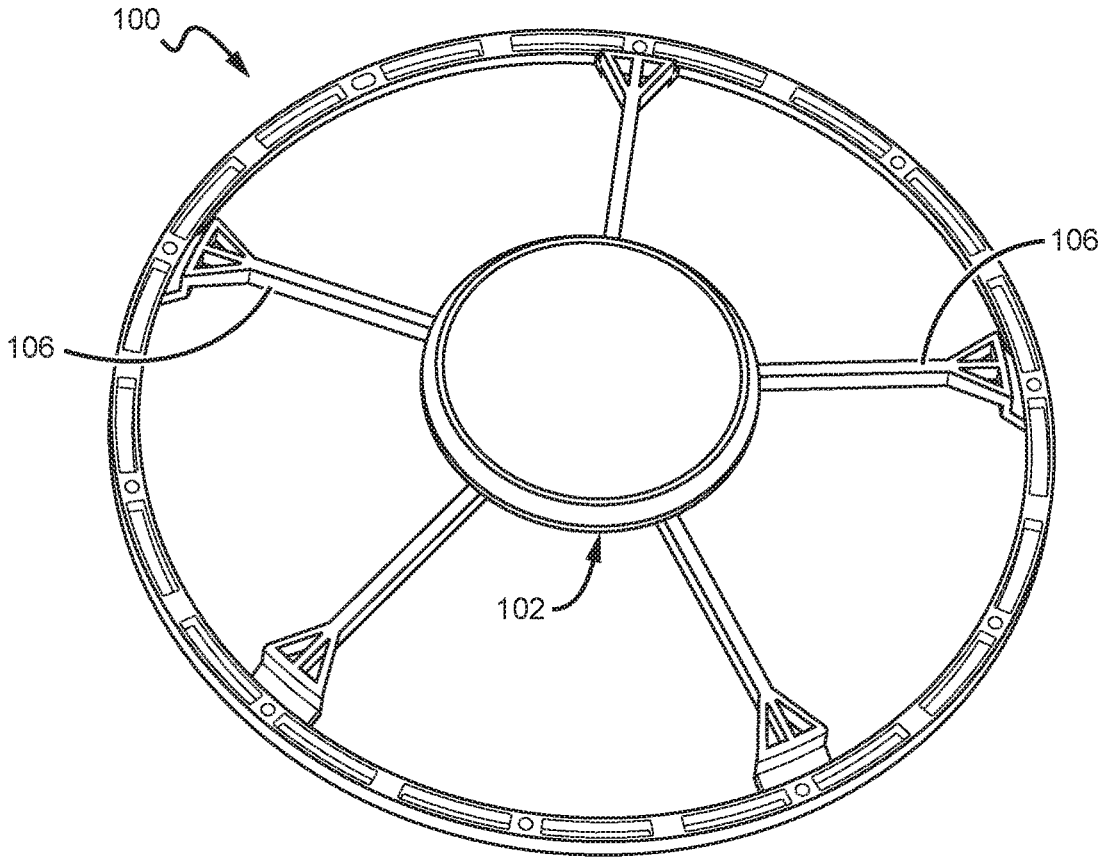
FIG. 1C
FIG. 2A
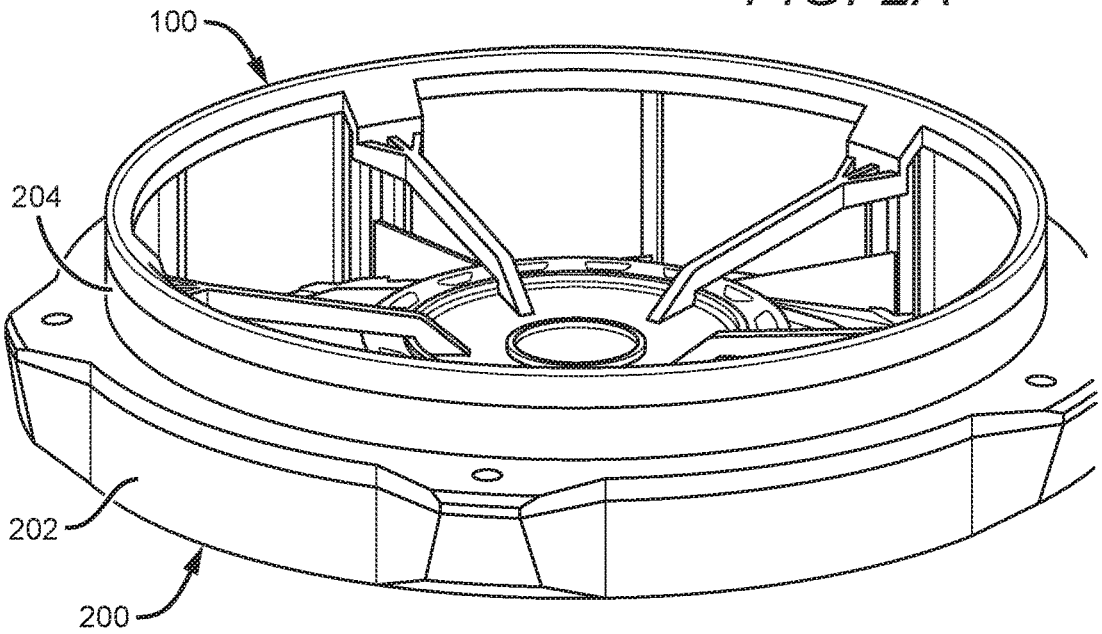

FIG. 2C
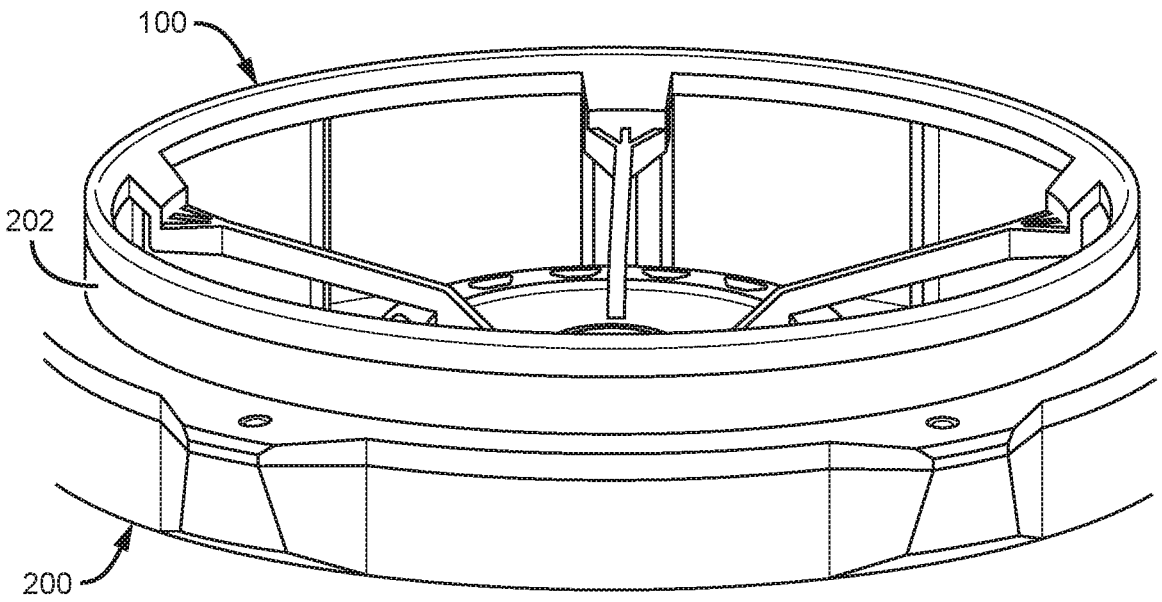
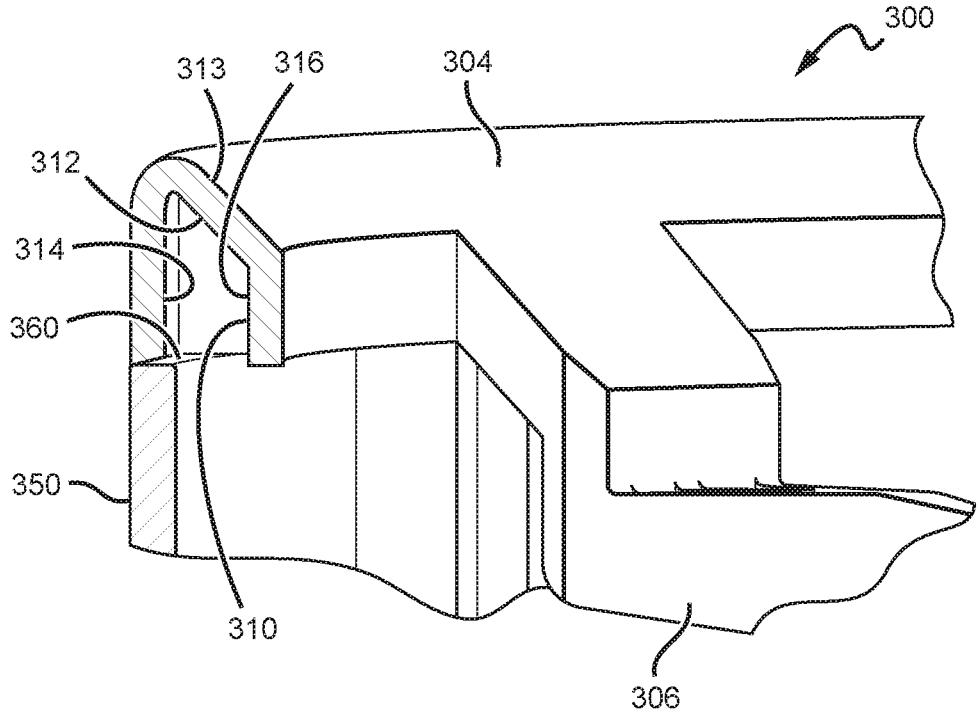
FIG. 3A

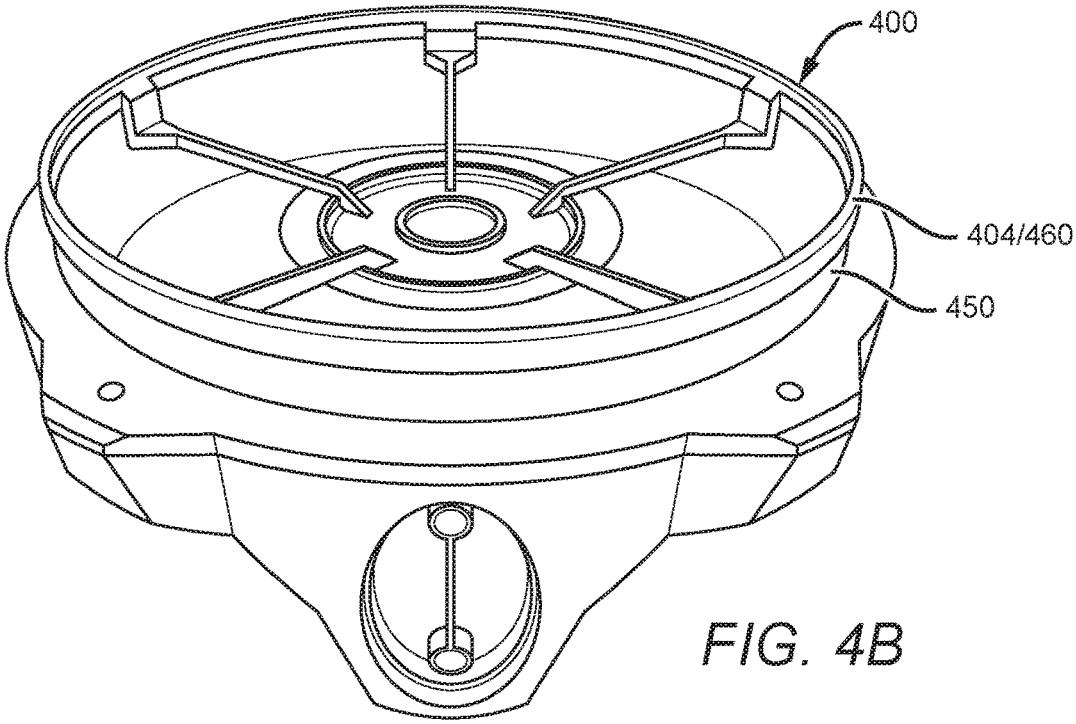
FIG. 4B
FIG. 5
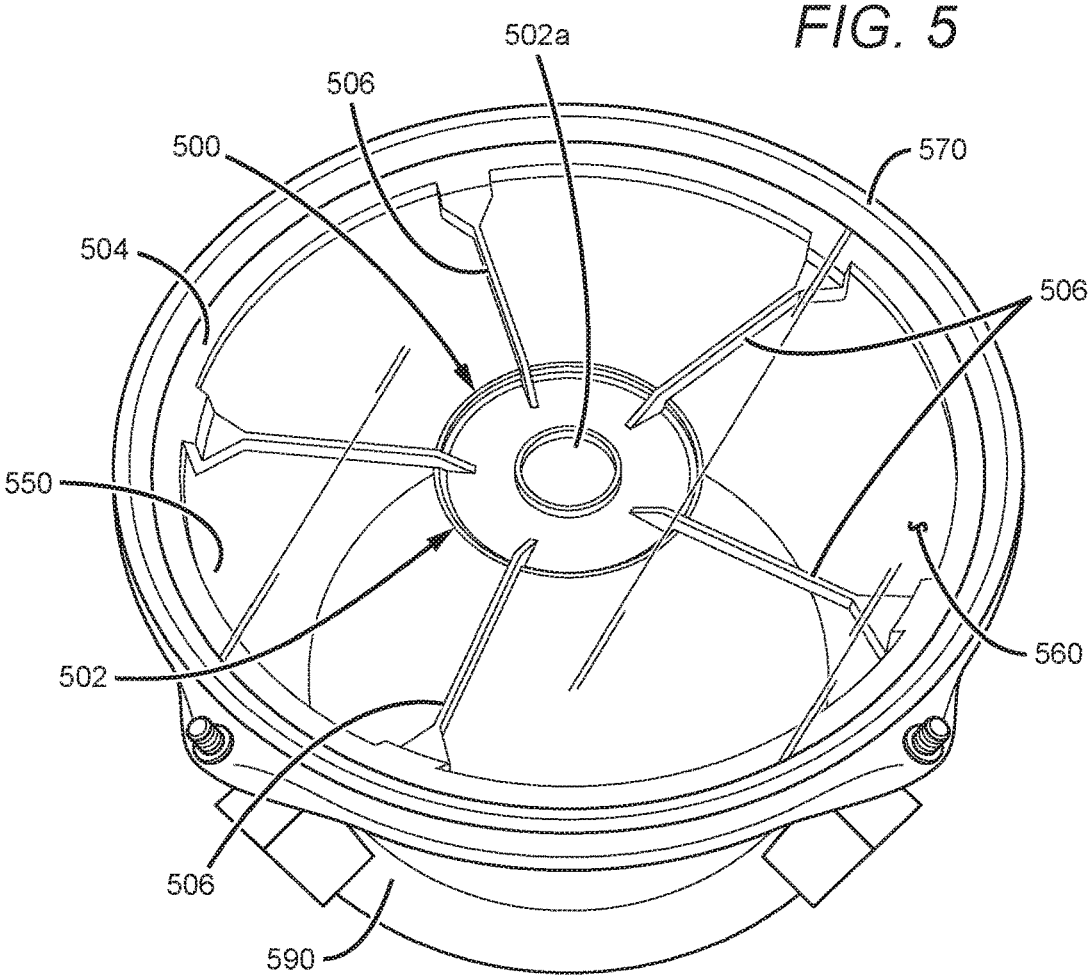

TRIGGER TRAY FOR PERCUSSION INSTRUMENT

This application claims the priority benefit of U.S. Provisional Pat. App. No. 62/437,609, entitled "Trigger Tray for Percussion Instrument" and filed on Dec. 21, 2016, the entire description, claims, and drawings of which are fully incorporated by reference herein.

BACKGROUND OF THE DISCLOSURE

Field of the Disclosure

This disclosure relates generally to devices for use with triggers used in conjunction with musical instruments, such as triggers used in conjunction with electronic percussion instruments.

Description of the Related Art

Drum triggers are devices used to produce an electronic, non-acoustic, and/or otherwise unnatural sound based on the actuation, striking, and/or vibration of a percussion instrument. In a typical setup, a trigger is placed in proximity to and/or on a percussion instrument surface which vibrates when actuated by a user. For instance, the trigger can be placed on a drum rim or the top side of a drum head. When a user actuates the drum head or drum rim, the head or rim physically moves, with the typical type of movement being vibration. The trigger receives and/or recognizes this vibration and sends a signal, such as an electronic signal, voltage, and/or current, to a sound module or similar device. The sound module then produces a given sound based on the characteristics of the signal. The produced sound can be similar to or the same as the natural sound of the acoustically-played instrument (e.g., a snare drum sound), and/or can be used for amplification purposes when the acoustic sound alone does not have a high enough volume. Alternatively, the produced sound could be different than the natural acoustically-produced sound. For instance, actuation of a triggered snare drum could produce a bell sound. Many different triggers and modules are known in the art, with examples being the RT-10K acoustic drum trigger and the TD-50 sound module, both available from Roland®.

Triggers can be used with any variety of instruments, including a number of different percussion-style instruments. For example, a trigger can be used with a traditional acoustic drum such as a snare or bass drum, and can produce the triggered sound in addition to the acoustic sound produced by the host instrument. Triggers can also be used with mesh head instruments, which are designed to produce relatively little or substantially no acoustic sound upon actuation by a user. Triggers are also commonly used with electronic drum pads, which are also designed to produce relatively little or substantially no acoustic sound in addition to the triggered electronic sound.

SUMMARY OF THE DISCLOSURE

The present disclosure relates to a trigger tray or similar device (collectively referred to herein as "trigger tray" for simplicity) for use with a musical trigger. The trigger tray can be used in conjunction with a drum head, mesh head, electronic drum pad, or other percussion device. The trigger tray can be mounted so as to be underneath the playing surface of the host instrument.

One embodiment of a trigger tray according to the present disclosure includes a substantially circular head mount portion, a trigger mount portion within the head mount portion, and a plurality of arms connecting the trigger mount portion and the head mount portion.

One embodiment of a drum assembly according to the present disclosure includes a drum shell with a wall having a bearing edge, and a trigger tray with a trigger mount portion, head mount portion, and plurality of arms connecting the head mount portion and trigger mount portion. The head mount portion is on the wall, and a drum head is on the trigger tray.

Another embodiment of a drum assembly according to the present disclosure includes a wall, a trigger tray on the wall, and a drum head or drum pad on the trigger tray. The trigger tray is configured to hold a trigger beneath the drum head or drum pad, and the trigger tray and the drum head or drum pad are mechanically linked such that vibrations of the drum head are transferred to the trigger tray.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further features and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

FIGS. 1A-1C are perspective views of a trigger tray according to one embodiment of the present disclosure.

FIGS. 2A-2C are perspective views of a trigger tray on part of a drum pad assembly according to one embodiment of the present disclosure.

FIGS. 3A and 3B are magnified cut-away views of parts of trigger tray arrangements according to two embodiments of the present disclosure.

FIG. 4B is an assembled view of the trigger tray and part of a drum pad assembly shown in FIG. 4A.

FIG. 5 is a perspective view of a drum assembly including a trigger tray according to the present disclosure.

DETAILED DESCRIPTION OF THE DISCLOSURE

Figure 2B:
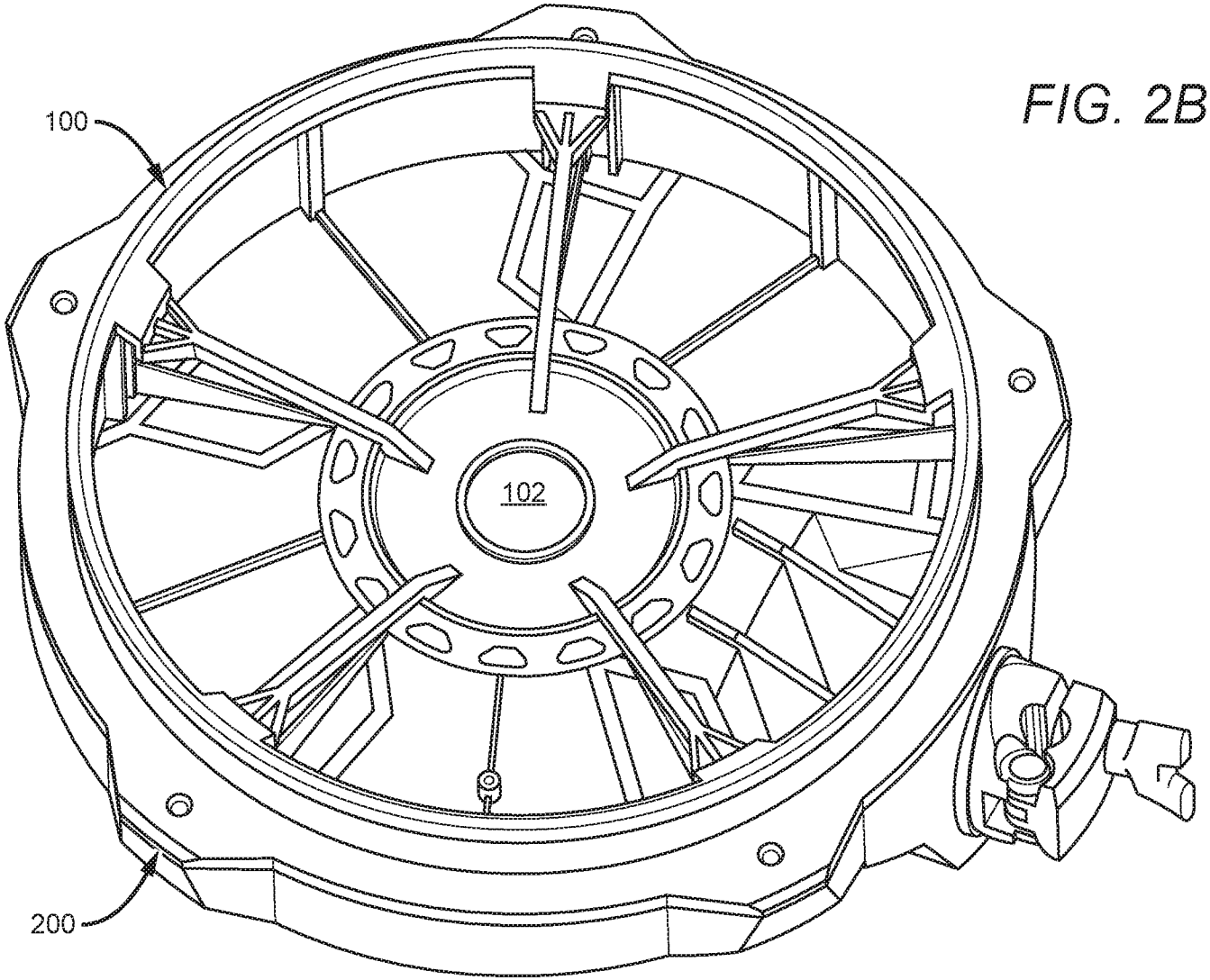

The present disclosure relates to trigger trays for use with percussion instruments, and specifically for percussion instruments including an electronic component. The trigger trays can include a circular head mount portion for mounting on a drum shell wall or similar device, and can further include a trigger mount portion where an electronic trigger can be mounted. The trigger can then be connected, such as through a wire or mechanically through the trigger tray itself, to a portion of the drum played by a person, such as the drum head. The vibrations of the drum head can, such as through vibration of the trigger tray or through another type of signal, actuate the trigger. The head mount portion of the trigger tray can include a cutout on the underside thereof, which can result in lower weight and/or can be used for connection to the drum shell wall. Arms of the trigger tray, such as three or more arms, can connect the head mount portion to the trigger mount portion. These arms can be downwardly angled from the head mount portion to the trigger mount portion.

It is understood that when an element is referred to as being "on" another element, it can be directly on the other element or intervening elements may also be present. Further, when one element is referred to as being "connected" to another element, it can be directly connected to the other element or intervening elements may also be present as would be understood by one of skill in the art. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe positional and/or angular relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present disclosure.

Embodiments of the disclosure are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to necessarily illustrate the precise shape of a region and are not intended to limit the scope of the disclosure.

FIGS. 1A and 1B show one example of a trigger tray 100 according to an embodiment of the present disclosure. The trigger tray 100 can include various components, such as a trigger mount portion 102, a head mount portion 104, and arms 106 that can be between and/or connect the trigger mount portion 102 and head mount portion 104, and/or can be within the head mount portion 104 as shown in FIGS. 1A-1C.

The trigger mount portion 102 can include a trigger mount surface 102*a*, upon which a trigger (not shown) can be placed. The trigger can be permanently or removably attached to the trigger mount portion 102 such as to the trigger mount surface 102*a*, can be placed loosely on the trigger mount portion 102 such as on the trigger mount surface 102*a*, or can otherwise be in direct or indirect contact with the trigger mount portion 102. The trigger mount portion 102 is shown as approximately in the center of the trigger tray 100, the head mount portion 104, and the arrangement of arms 106. However, it is understood that the trigger mount portion 102 may not be in a center position, and may be located elsewhere on the trigger tray 100. Additionally, while the trigger mount portion 102 is shown as a portion of the trigger tray 100 that is distinct from the head mount portion 104 and arms 106, it is understood that a distinct trigger mount portion may not be present in other embodiments. For example, a portion of one or more arms 106 (such as an area where a plurality of arms 106 meet, such as in the center of the trigger tray 100 and/or the head mount portion 104) could serve as a trigger mount portion, or a portion of the head mount portion 104 could serve as a trigger mount portion. Additionally, while a single trigger mount portion 102 is shown, it is understood that two or more trigger mount portions (whether as distinct elements or as parts of other elements, or a combination thereof) can be included in the trigger tray 100. In one such embodiment the striking of different portions of the drum head or other element can thus activate different triggers, which may each cause different sounds to be produced. The trigger mount portion 102 is shown as circular/annular, but it can be any shape, including but not limited to oval, regular or irregular polygon-shaped, etc.

Trigger trays according to the present disclosure, such as the trigger tray 100, can include any number of arms 106, including one arm, two arms, three arms, four arms, five arms, six arms, or more arms, with the third arm having an excellent effect on overall stability. The particular embodiment shown includes five arms. The arms 106 can be generally downwardly angled as they move inward, such as from the head mount portion 104 inward, and such as from the head mount portion 104 to the trigger mount portion 102, as seen best in FIG. 1B. This downward angle can permit the trigger mount portion 102 and/or trigger to sit an appropriate distance below a drum head or drum pad thereabove. The arms 106 can be equally-spaced from one another, or can be unequally spaced from one another.

FIGS. 2A-2C show the trigger tray 100 mounted on a drum pad assembly 200. The drum pad assembly 200 can include a drum pad base 202, a drum pad wall 204, and a drum pad (not shown, which would be placed on and/or over the trigger tray 100). As can be seen, the trigger tray 100 may be substantially or completely concealed beneath the drum pad, and the trigger can be attached to or in contact with an underside of the drum pad. This has distinct advantages over the prior art, as attachment of the trigger to an underside of the drum pad (or to the underside of any actuation device, such as a drum head, drum rim, etc.) may be more secure and reduce the chances of accidental dislodging of the trigger from the playing surface.

FIG. 3A shows part of a trigger tray 300 in proximity to a wall or mount 350 (referred to herein as a "wall" for simplicity). The trigger tray 300 can be the same as or similar to the trigger tray 100 previously described. The wall 350 could be, for instance, a drum pad wall the same as or similar to the drum pad wall 204, a drum shell wall, or similar. FIG. 3A shows a head mount portion 304 and one arm 306 of the trigger tray 300, with the rest of the trigger tray 300 not shown. As can be seen, the head mount portion 304 may have a cross-section shaped to define a cutout 310. The cutout 310 can be on a bottom or underside of the head mount portion 304, as shown, or can be elsewhere. The cutout 310 may be shaped so as to accommodate a bearing edge 360 of the wall 350. The cutout 310 is shown as having a downward-sloping (from outer edge to inner edge) top inner surface 312 and top outer surface 313 (designed for a traditional bearing edge), and two vertical side inner surfaces 314,316, while the bearing edge 360 is shown as having a substantially rectangular cross-section. However, many different shapes for both the cutout 310 and the bearing edge 360 are possible, and the shapes can be the same (e.g., both rectangular), or different (e.g., as shown). Many different connections, including a male/female-style connection where one piece fits within another, are possible. For example, in one embodiment the inner walls/surfaces 314/316 fit snugly about a wall and/or bearing edge such as the wall 350 and bearing edge 360, which can aid in stability. In FIG. 3A the trigger tray 300 is shown as slightly raised over the wall 350, and the trigger tray 300 can be lowered such that the top inner surface 312 of the cutout 310 rests on a surface of the bearing edge. While in the specific embodiment shown the head mount portion 304 includes the cutout 310 for accommodating the bearing edge 360, it is understood that other components could include cutouts for accommodating a bearing edge, or that a cutout may not be included. For example, in one embodiment a trigger tray does not include a head mount portion, and/or a plurality of arms include cutout portions for attachment to the bearing edge such that the head mount portion is not necessary. Inclusion of a cutout such as the cutout 310 can result in a lighter overall trigger tray weight. Further, trigger trays need not necessarily include cutouts, and those trigger trays with cutouts need not necessarily be designed to fit over a drum sidewall with a cutout over the bearing edge; the trigger tray can instead simply rest on top of and/or over the bearing edge 360. The wall 350, bearing edge 360, and head mount portion 304 can all be substantially the same shape, such as circular, or can be shaped differently.

Triggers can also be placed in cutouts such as the cutout 310. This can be particularly applicable for triggers intended to detect movement based upon actuation of a rim such as a snare drum rim, or a "rimshot."

Trigger trays and cutouts of trigger trays according to the present disclosure can be designed for many different types of bearing edges at many different angles, including but not limited to rectangular, traditional (i.e., downward-sloped), double (i.e., including two slopes that come to a substantial point), roundover (i.e., including a rounded top portion), combinations including both sloped and rounded portions (such as SoniClear™ bearing edges), and can have varying angles, such as angles of 45°, 60°, between 45° and 60°, between 35° and 70°, and other angles. Trigger tray cutouts can be shaped to accommodate a bearing edge with a substantially flat top surface, such as a rectangular bearing edge or a SoniClear bearing edge.

Figure 3B:
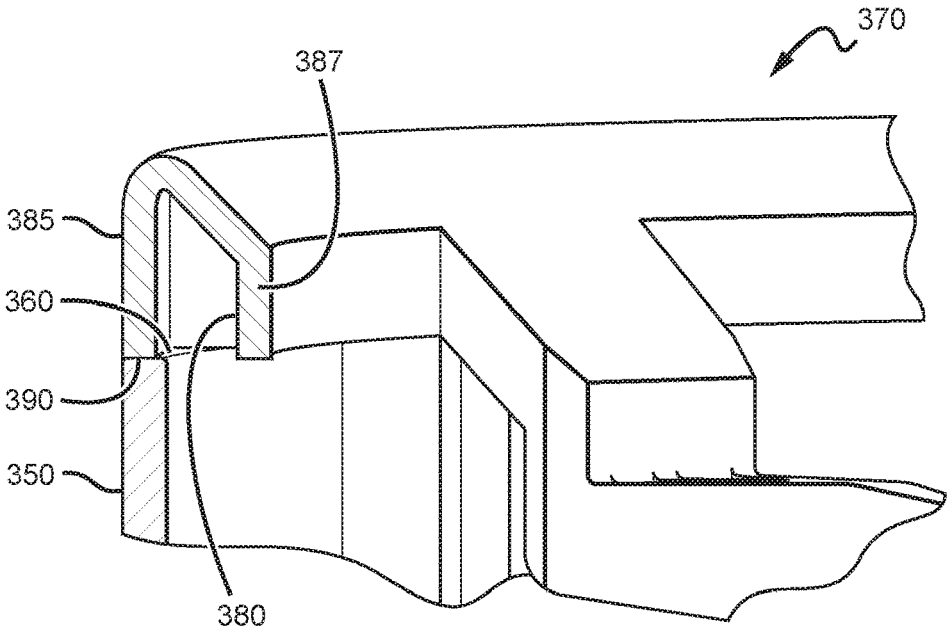

In other embodiments, the head mount portion may not include a cutout, and/or may simply be placed on top of the bearing edge and secured using other means. For example, such a trigger tray could be secured using the method described below with regard to FIG. 5. FIG. 3B shows one embodiment of part of a trigger tray 370 that is placed on and rests on the bearing edge 360. The bottom 390 of the trigger tray 370 rests on the bearing edge 360. While in the specific embodiment shown the trigger tray 370 includes a cutout 380 and the bottom 390 of the outer wall 385 resting on the bearing edge 360, it is understood that the bottom of the inner wall 387 could rest on the bearing edge, or alternatively no cutout is included and the bottom of the trigger tray 370 rests on the bearing edge 360. Many different embodiments are possible. Inclusion of a cutout such as the cutout 380 can be beneficial in that it results in a lighter weight device than trigger trays not including a cutout.

Embodiments of the present disclosure, including but not limited to those embodiments shown in FIGS. 1-3B, can also include one or more bumper elements within or just below a cutout, and/or on a bearing edge. Such bumper elements can protect the bearing edge such as the bearing edge 360, and can also aid in fitting. Such bumper elements can comprise elastic material. Bumper elements can also aid in stabilizing the connection between the side wall and trigger tray, in that the fit including a bumper element can be more snug. One example of a bumper element according to the present disclosure is a rubber bumper element.

Figure 4A:
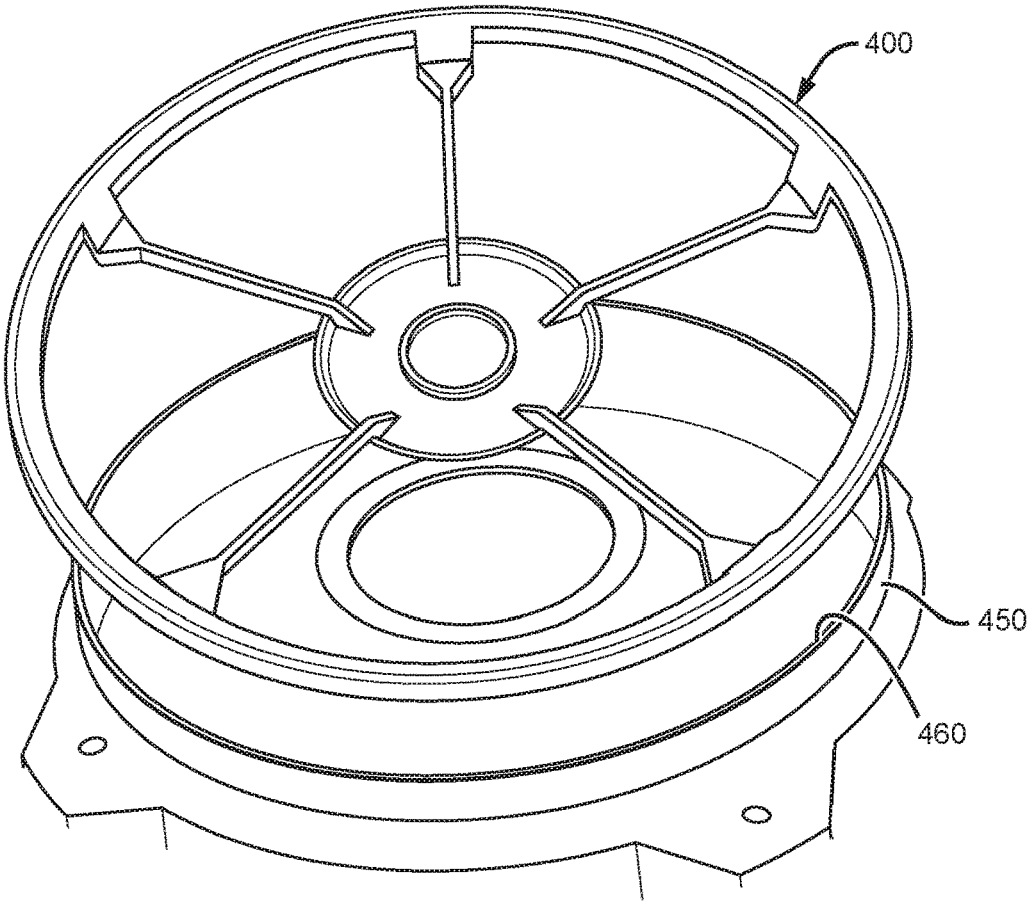
FIG. 4A is an exploded view of a trigger tray and part of a drum pad assembly according to the present disclosure.

FIGS. 4A and 4B show another example of a trigger tray 400 and a wall 450, with a head mount portion 404 fitting over or on top of the bearing edge 460 of the wall 450. The trigger tray 400 and wall 450 are shown as separated in FIG. 4A, with FIG. 4B showing the trigger tray 400 engaged with the wall 450, and showing the head mount portion 404 engaged and/or mounted onto the bearing edge 460.

FIG. 5 shows a drum assembly 590 according to the present disclosure, the drum assembly 590 including a trigger tray 500. Trigger trays according to the present disclosure can be made of or comprise metal, plastic, composite materials, and/or other materials. The trigger tray 500 can be the same as or different than any of the trigger trays previously shown or described, such as the trigger tray 100, for example. The trigger tray 500 may include a trigger mount portion 502 (which may include a trigger mount surface 502*a*), head mount portion 504, and one or more arms 506. The trigger mount portion 502, head mount portion 504, and/or arms 506 may be the same or similar to previously described corresponding components, such as the trigger mount portion 102, head mount portion 104, and arms 106, respectively. As shown, the trigger tray 500 can be mounted on a drum shell 550 (such as a drum shell wall), with a drum head 560 placed on and/or over the trigger tray 500 (such as on and/or over the head mount portion 504), and a drum hoop 570 (such as, for example, such as a True Hoop® available from Drum Workshop®) can be placed on the drum head 560, with the components of the assembly 500 then secured, such as secured using tension rods as is known in the art. In some embodiments, the trigger tray can be mechanically linked to the playing surface such that vibrations are transferred from the playing surface to the trigger tray. In this manner, the trigger need not necessarily be directly hooked up to the drum head itself, but can instead receive the vibrations from the trigger tray. Other embodiments are possible, such as where the trigger receives vibration via a wire or other connection to a drum head (such as the underside thereof), and combinations of these mechanisms are also possible. Both physical and electronic connections (e.g. wireless connections) are possible. The arms 506 can be generally downwardly angled as previously described with regard to the trigger tray 100, such that the trigger mount portion 502 is beneath the drum head 560 and/or such that the trigger mount portion 502 is at a lower height than a bearing edge of a drum shell/wall/etc.

While the above describes mounting a trigger tray upon another device such as a drum pad wall or drum shell wall, trigger trays according to the present disclosure can also be designed for use independent of a wall. For example, the trigger tray 100 (shown in FIGS. 1A-2C) can include a plurality of flat surfaces 150. In the specific embodiment shown, the flat surfaces are formed by three prongs 152 of each of the arms 106. However, it is understood that flat surfaces can be formed in other manners, including but not limited to by the arms themselves without prongs, by two prongs per arm, by four or more prongs per arm, by a widened areas of one or more arms, by a ledge, by a ledge of the head mount portion 104, and by many other devices and shapes. In the embodiment shown, the flat surfaces are approximately equidistant from the center of the trigger tray 100, although other embodiments are possible. A circular/annular playing surface (or a differently shaped playing surface), such as a drum pad, drum head, drum mesh, etc. could be placed upon and/or mounted to the flat surfaces 106 to provide a triggered playing surface. Typically, three or more flat surfaces 150 can provide sufficient stability for such a playing surface, though one flat surface, two flat surfaces, four flat surfaces, or more flat surfaces are possible. In such embodiments where an alternative playing surface is mounted on the trigger tray 100 such as on the flat surfaces 150, vibrations can be transferred directly to the trigger from the playing surface, and/or could be transferred through one or more portions of the trigger tray 100, such as through the flat surfaces 150, the arms 106, and/or the trigger mount portion 102. Other connections including but not limited to those previously describe dare possible. While this specific embodiment describes flat surfaces as the auxiliary mount surfaces that can be used for mounting an alternative playing surface, it is understood that non-flat mount surfaces, such as angled surfaces, could also be used. Walls 154 proximate and/or adjacent to the flat surfaces 150 can help to contain and/or secure the alternative playing surface. The walls 154 can be vertical or angled in another manner.

In some embodiments, trigger trays according to the present disclosure can include an adjustment device for adjusting to the size of an alternative playing surface to hold it in place. For example, one or more elements can be attached to one or more of the arms 106 and/or prongs; these adjustment elements can then be slid along their respective arms and/or prongs, and/or can be locked into place once in position, so as to hold an alternative playing surface in place and prevent it from being unintentionally displaced. These adjustment elements could include walls similar to the walls 154, which can help to contain and/or secure the alternative playing surface. In one embodiment a head mount portion is not included.

Additionally, the trigger tray 100 may be adjustable so as to be able to accommodate many different sizes of drum. Commonly assigned U.S. Utility Patent Application Pub. No. 2016/0210943 to Sikra et al., entitled "Drum Stand Basket with Spring Adjustment and Other Features" (U.S. Utility patent application Ser. No. 15/002,373; now U.S. Pat. No. 9,721,549) which is fully incorporated by reference herein in its entirety, describes a system utilizing three or more arms which can be applied to the present disclosure. By using one arm having an adjustable length, such as adjustable via a spring and lock system, and two arms having adjustable annular positions, the arms can be adjusted to various different positions so as to accommodate differently sized drums. It is understood that fewer or more than three arms are possible, and that more than one spring-loaded arm, and less than or more than two annularly adjustable arms, are possible. In one embodiment, a head mount portion is not included and the arms include cutouts for accommodating a bearing edge, and the arms can be adjusted so as to fit different drum sizes. In one embodiment, adjustable arms such as those described are included, and/or a head mount portion is included that has an adjustable radius, such as by including a portion of smaller cross-section that can slide into and/or out of a portion having a larger cross-section and then be locked into position. In another embodiment, a plurality of arms are spring-loaded and can be locked into place. Many different embodiments are possible.

Trigger trays according to the present disclosure may have distinct advantages over the prior art in addition to those previously described. For example, a user need only learn one process of trigger installation, which is installation of the trigger on the tray and the tray on the host device (as opposed to various mounting processes for different types of triggers). No drilling or other fixing methods are necessary to install trigger trays according to the present disclosure. Trigger trays according to the present disclosure can convert most acoustic drums, pads, etc. to electronic drums. Trigger trays according to the present disclosure can incorporate elements described and/or shown in U.S. Pat. No. 7,385,135 to Yoshino et al., which is fully incorporated by reference herein in its entirety.

Although the present disclosure has been described in detail with reference to certain preferred configurations thereof, other versions are possible. Therefore, the spirit and scope of the disclosure should not be limited to the versions described above.

I claim:

1. A trigger tray, comprising:

a substantially circular and contiguous head mount portion;

a trigger mount portion within said head mount portion;

a plurality of arms connecting said trigger mount portion to said head mount portion; and a plurality of adjustment elements, each of said adjustment elements slidable along at least a portion of one of said arms so as to adjust to a size of an alternative playing surface, wherein each of said adjustment elements can be locked into place so as to substantially secure said alternative playing surface.

2. The trigger tray of claim 1, wherein said trigger mount portion is in the center of said head mount portion.

3. The trigger tray of claim 1, wherein said plurality of arms comprises three or more arms.

4. The trigger tray of claim 1, wherein each of said plurality of arms comprises a mount surface configured to hold said alternative playing surface.

5. The trigger tray of claim 4, wherein each of said mount surfaces is a flat surface formed by two or more prongs of its respective arm.

6. The trigger tray of claim 4, further comprising said alternative playing surface on said mount surfaces.

7. The trigger tray of claim 1, wherein said arms are generally downwardly angled from said head mount portion to said trigger mount portion.

8. The trigger tray of claim 1, wherein said head mount portion is shaped to define a cutout on an underside thereof.

9. The trigger tray of claim 1, wherein said head mount portion, said trigger mount portion, and said plurality of arms are integral with one another.

10. The trigger tray of claim 9, wherein said head mount portion is shaped to define a cutout configured to receive a bearing edge of a drum shell wall.

11. A drum assembly, comprising:

a drum shell comprising a wall, said wall comprising a bearing edge;

a trigger tray comprising a trigger mount portion, a head mount portion, a plurality of arms connecting said head mount portion to said trigger mount portion, and a plurality of adjustment elements, each of said adjustment elements slidable along at least a portion of one of said arms so as to adjust to a size of an alternative playing surface, each of said adjustment elements can be locked into place so as to substantially secure said alternative playing surface; and a drum head on said trigger tray, wherein said head mount portion is shaped to define a cutout on a bottom side thereof, and said bearing edge is within said cutout.

12. The drum assembly of claim 11, further comprising a trigger on said trigger mount portion, said trigger connected to an underside of said drum head.

13. The drum assembly of claim 11, wherein said head mount portion and said bearing edge are substantially circular.

14. The drum assembly of claim 11, wherein said trigger mount portion is substantially in the center of said head mount portion.

15. The drum assembly of claim 11, further comprising a drum hoop on said drum head.

16. The drum assembly of claim 11, wherein said arms are generally downwardly angled from said head mount portion to said trigger mount portion such that said trigger mount portion is beneath said drum head, and such that said trigger mount portion is at a height lower than a height of said bearing edge.

17. The drum assembly of claim 13, wherein said head mount portion is contiguous.

18. A drum assembly, comprising:

a wall;

a trigger tray, said trigger tray comprising a contiguous circular head mount portion on a bearing edge of said wall, a trigger mount portion within said head mount portion, a plurality of arms connecting said trigger mount portion to said head mount portion, and a plurality of adjustment elements, each of said adjustment elements slidable along at least a portion of one of said arms so as to adjust to a size of an alternative playing surface, each of said adjustment elements can be locked into place so as to substantially secure said alternative playing surface; and a drum head on said trigger tray, wherein said trigger tray is configured to hold a trigger beneath said drum head, said trigger tray and said drum head are mechanically linked such that vibrations of said drum head are transferred to said trigger tray.

19. The drum assembly of claim 18, further comprising said trigger.

20. The drum assembly of claim 19, wherein said trigger is connected to an underside of said drum head.

21. The drum assembly of claim 18, wherein said head mount portion is shaped to define a cutout, and wherein said bearing edge is within said cutout.

22. The drum assembly of claim 18, further comprising said trigger;

wherein said trigger is configured to be actuated by said vibrations of said drum head that are transferred to said trigger tray.

* * * * *